US009078060B2

(12) United States Patent
Boyce

(10) Patent No.: US 9,078,060 B2
(45) Date of Patent: Jul. 7, 2015

(54) SEALED SPEAKER ENCLOSURE

(71) Applicant: DEERE & COMPANY, Moline, IL (US)

(72) Inventor: Dean A. Boyce, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 13/951,090

(22) Filed: Jul. 25, 2013

(65) Prior Publication Data

US 2015/0027803 A1 Jan. 29, 2015

(51) Int. Cl.
*H04R 1/02* (2006.01)

(52) U.S. Cl.
CPC ..... *H04R 1/023* (2013.01)

(58) Field of Classification Search
CPC ..... H04R 1/02
USPC ..... 181/199, 198
See application file for complete search history.

(56) References Cited

U.S. PATENT DOCUMENTS

| | | | | | |
|---|---|---|---|---|---|
| 4,244,096 | A * | 1/1981 | Kashichi | 29/432 |
| 4,284,166 | A * | 8/1981 | Gale | 181/156 |
| 5,113,968 | A * | 5/1992 | Lemmon | 181/148 |
| 5,115,884 | A * | 5/1992 | Falco | 181/156 |
| 5,369,701 | A | 11/1994 | McAteer et al. | |
| 5,629,502 | A * | 5/1997 | Nakano | 181/156 |
| 5,696,357 | A * | 12/1997 | Starobin | 181/156 |
| 5,821,471 | A * | 10/1998 | McCuller | 181/156 |
| 5,896,461 | A | 4/1999 | Faraci et al. | |
| 6,956,956 | B2 * | 10/2005 | Kuratani et al. | 381/397 |
| 7,116,795 | B2 | 10/2006 | Tuason et al. | |
| 7,218,747 | B2 | 5/2007 | Huffman | |
| 7,319,774 | B2 * | 1/2008 | Suzuki | 381/386 |
| 8,091,681 | B2 * | 1/2012 | Stewart et al. | 181/152 |
| 2005/0089184 | A1 * | 4/2005 | Wang | 381/345 |

* cited by examiner

*Primary Examiner* — Forrest M Phillips

(57) ABSTRACT

A speaker enclosure includes a seal and a speaker grille with a tuned port. Mounting tabs are molded in the grille. The seal is engaged by a series of ribs which surround the grille mounting tabs and by a rib which surrounds the tuned port tube of the grille. The tabs have shoulders or stops which locate the grille relative to a front plate of the sound box. The sealing ribs around each tab have a height which provides the correct compression of the rubber foam seal material. As the speaker grille is installed using spring clips, the seal is compressed by the ribs to provide the seal required so that the space behind the speaker only vents through the tuned port.

10 Claims, 6 Drawing Sheets

SEALED SPEAKER ENCLOSURE

FIELD

The present disclosure relates to a speaker enclosure.

BACKGROUND

In agricultural tractor cabs, speaker enclosures do not use tuned port technology. As a result, most tractor cab audio systems provide a low quality of sound for the operator. High end sound systems use subwoofers in separate enclosures to generate low frequency sound. These separate enclosures may or may not use a tuned port. If a tuned port is used, it is normally a separate part attached to the sound box and is not incorporated into the speaker grille. To generate the best sound in lower frequencies from a speaker mounted in a sound box, a tuned port is designed to allow air and sound waves from the back of the speaker to exit the sound box. The port may be placed through any surface of the sound box as long as the air space it vents is from the back side of the speaker. A speaker grille is mounted over the speaker to protect the speaker face from damage. Such a system requires multiple parts, seals, and fasteners to create a proper sound box for the speaker to provide good performance.

SUMMARY

According to an aspect of the present disclosure, a speaker enclosure includes a seal and a speaker grille with a tuned port. Mounting tabs are molded in the grille. The seal is engaged by a series of ribs which surround the grille mounting tabs and by a rib which surrounds the tuned port tube of the grille. The tabs have shoulders or stops which locate the grille relative to a front plate of the sound box. The sealing ribs around each tab have a height which provides the correct compression of the rubber foam seal material. As the speaker grille is installed using spring clips, the seal is compressed by the ribs so that the tuned port, and the ribs which surround the tabs are all sealed to the front plate of the sound box. As a result, the air space behind the speaker only vents through the inside of the tuned port.

The seal member is a single piece of closed cell foam rubber seal. The speaker grille with the mounting tabs and the properly designed tuned port results in a sealed sound box which provide the best quality sound from the speaker mounted in the enclosure. This assembly requires only a single seal part, a single grille with the tuned port shape molded in mounted with hidden fasteners. This reduces the number of parts and assembly cost as the speaker grille just snaps to the front plate of the sound box.

DETAILED DESCRIPTION OF THE DRAWINGS

Figure 1:
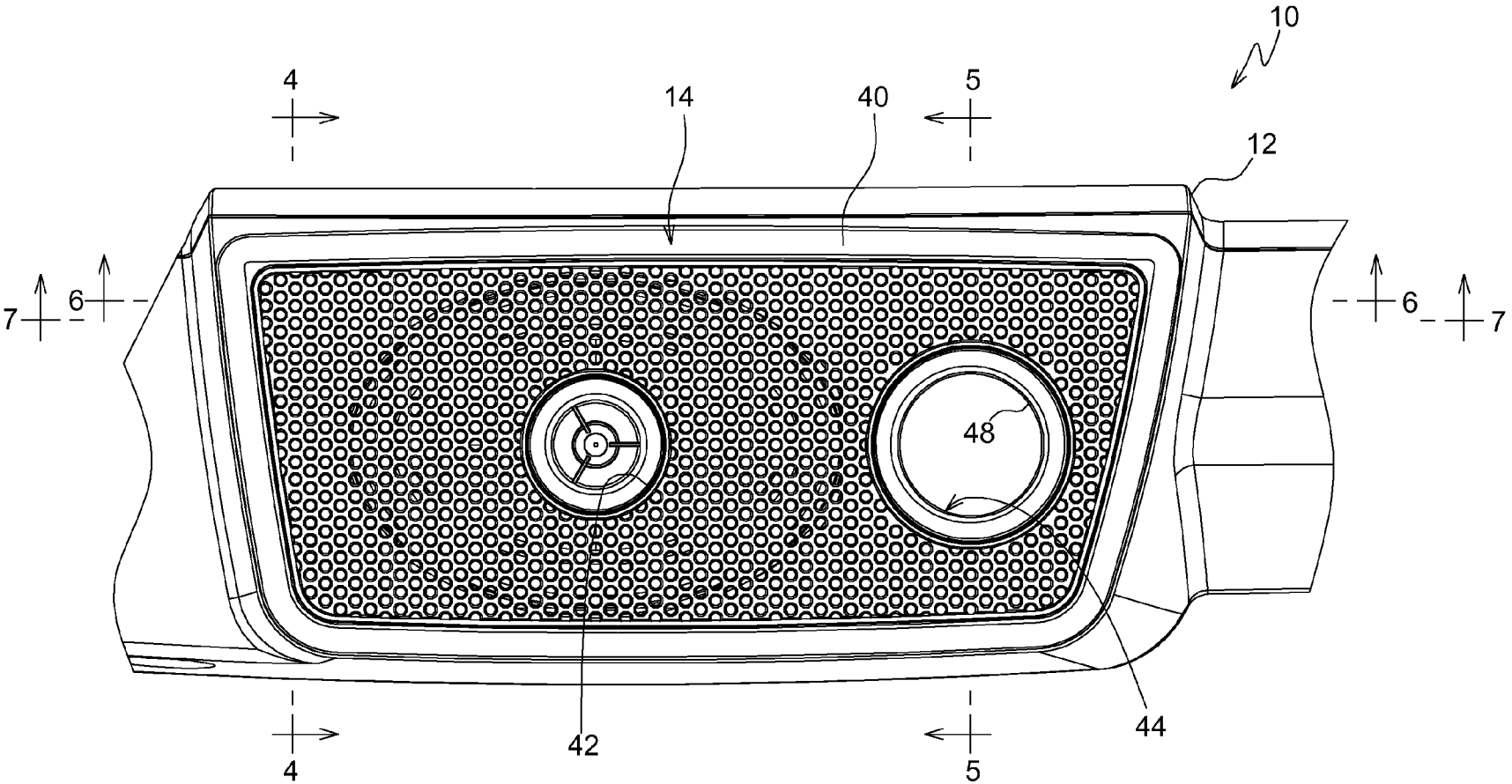
FIG. 1 is a front view of a speaker enclosure embodying the invention.
Figure 2:
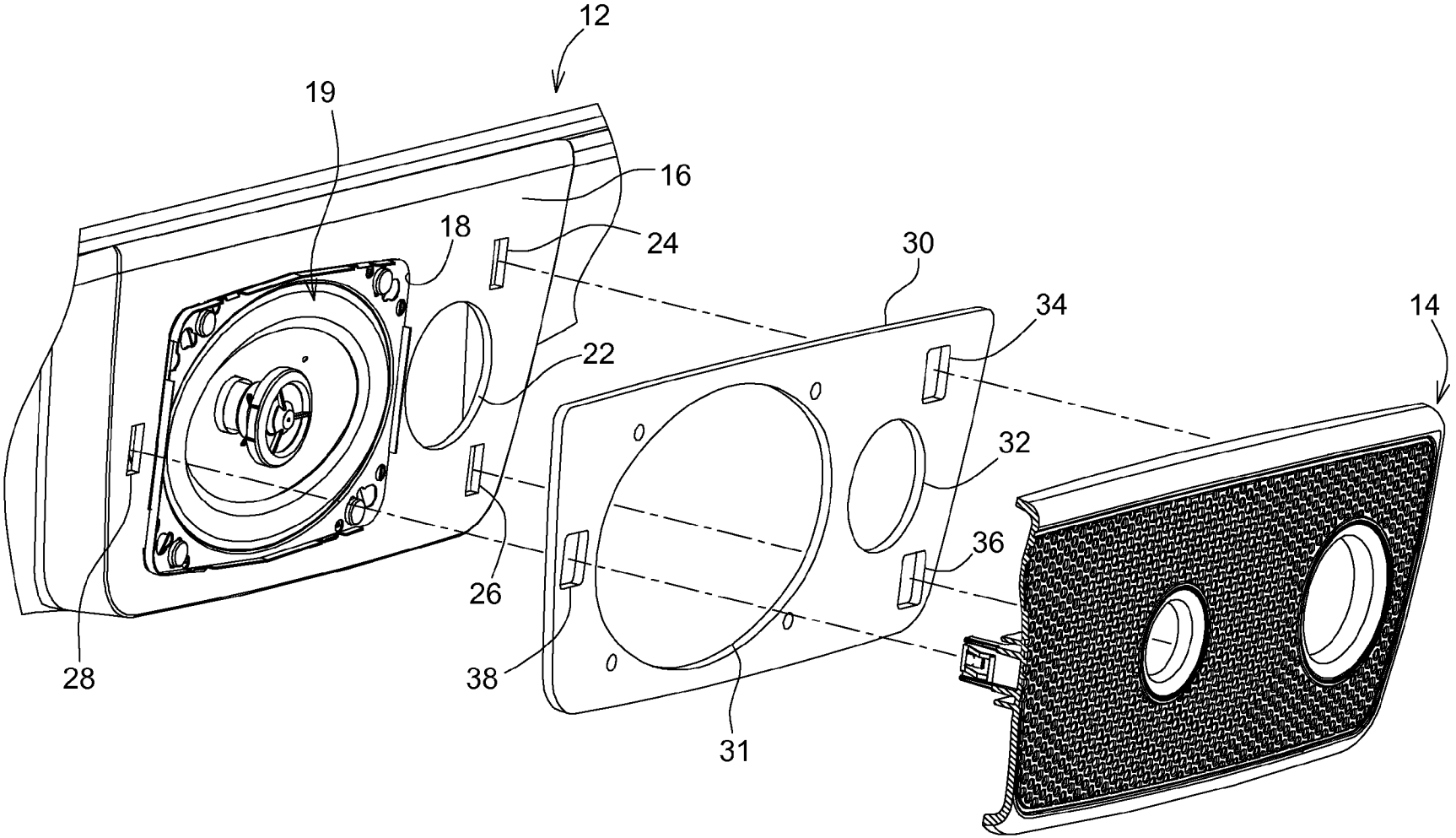
FIG. 2 is a perspective exploded view of the speaker enclosure of FIG. 1.

Referring to FIGS. 1 and 2, a speaker assembly 10 includes a speaker box 12 and a speaker grille 14 which mounted to the box 12. As best seen in FIG. 2, the box 12 includes an attachment plate 16. The attachment plate 16 includes a speaker opening 18 in which is mounted a conventional audio speaker 19. A tuned port opening 22 is spaced apart from the speaker opening 18. A plurality of rectangular attachment slots 24, 26 and 28 are spaced apart and formed in the plate 16.

A generally rectangular resilient seal member 30 is held between the grille 14 and the attachment plate 16. The seal member 30 includes a speaker opening 31 and a tuned port opening 32 which is spaced apart from the speaker opening 31. A plurality of rectangular attachment slots 34, 36 and 38 are spaced apart and formed in the seal member 30.

Figure 3:
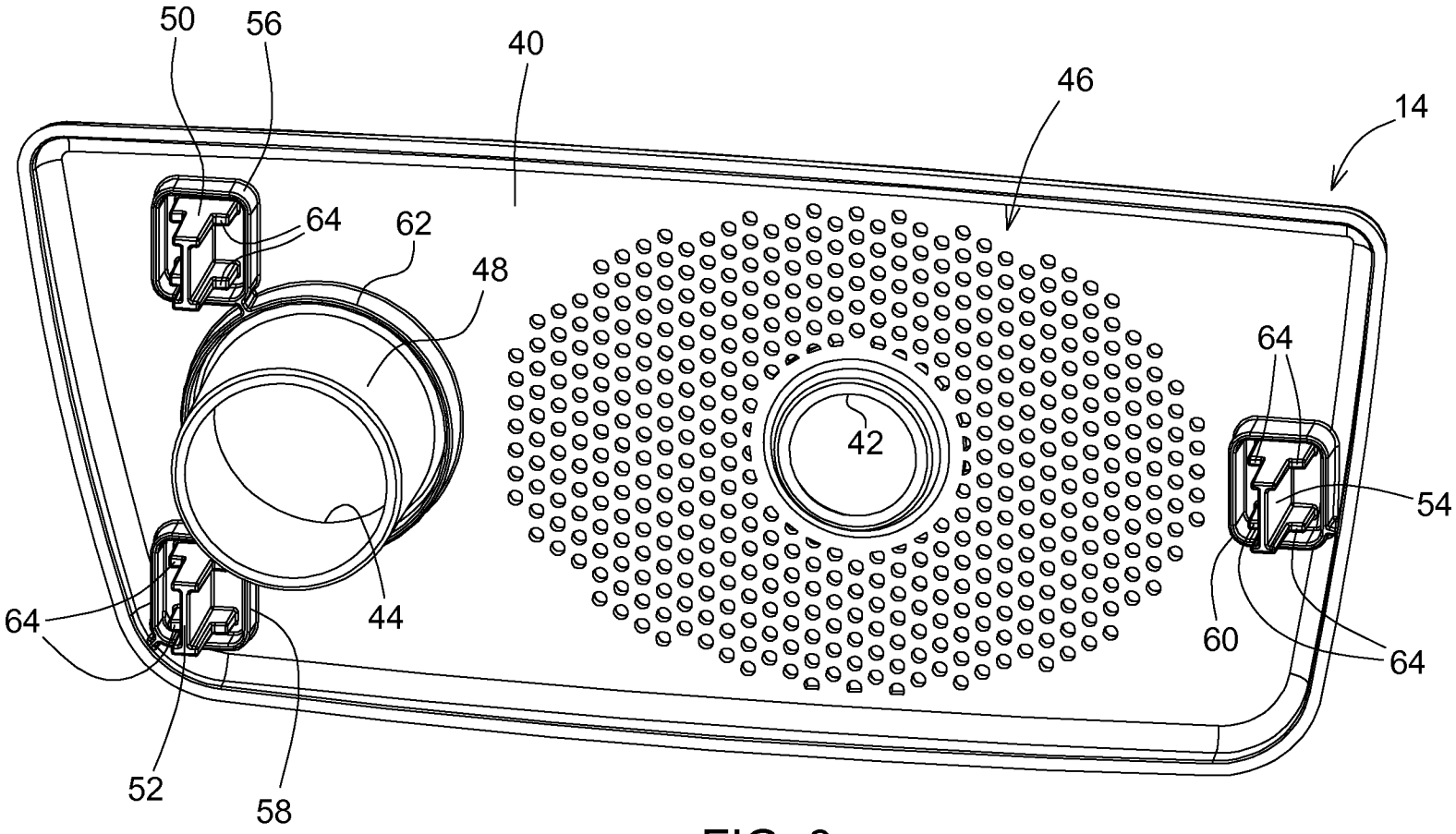
FIG. 3 is a rear perspective view of the grille of FIG. 1.
Figure 4:
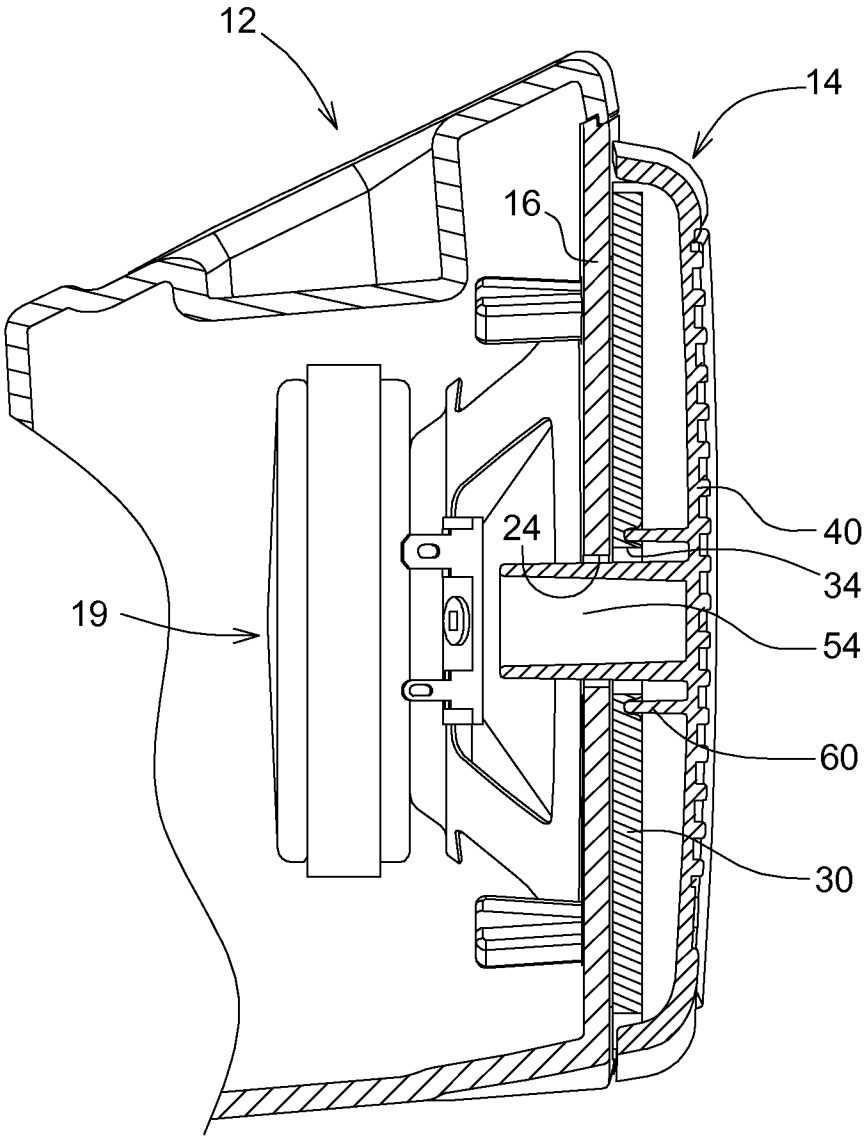
FIG. 4 is a sectional view along lines 4-4 of FIG. 1.
Figure 5:
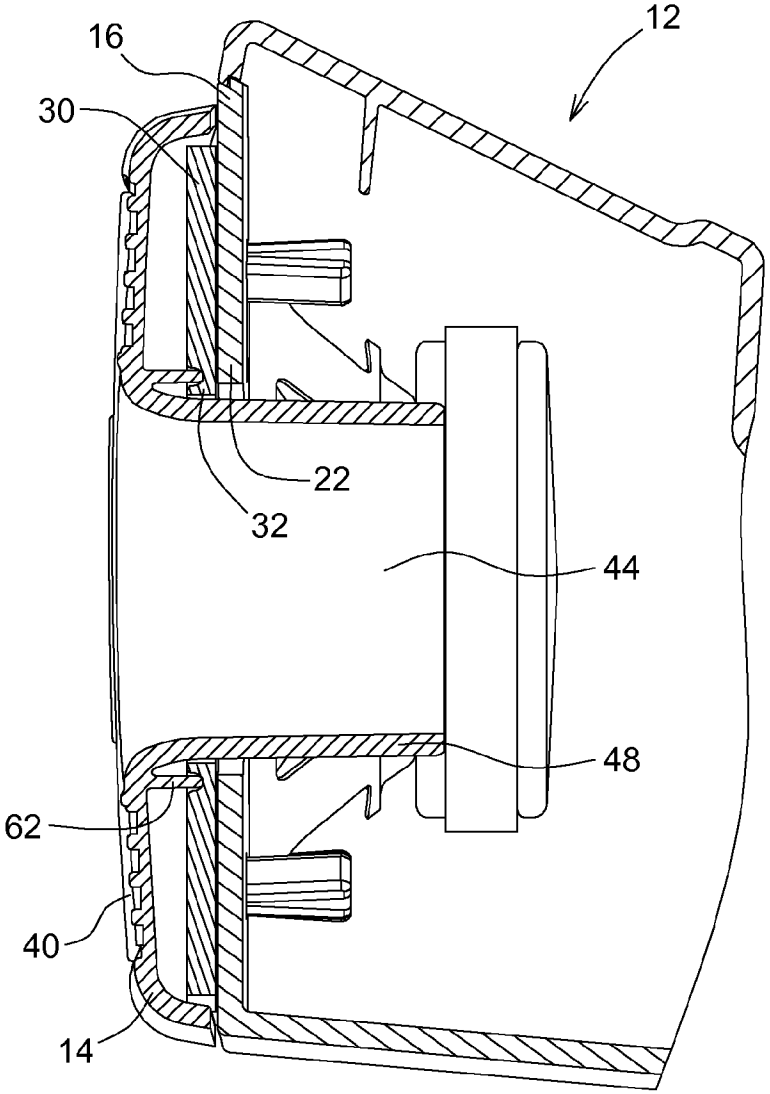
FIG. 5 is a sectional view along lines 5-5 of FIG. 1.
Figure 6:
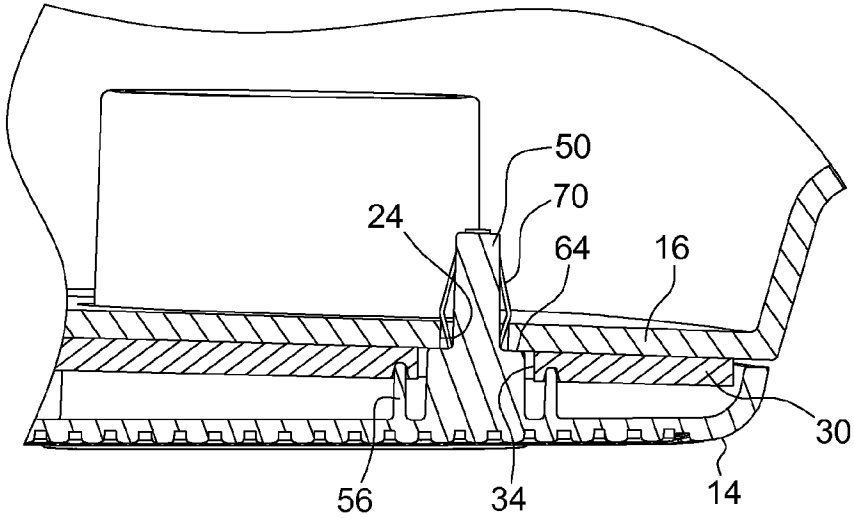
FIG. 6 is a sectional view along lines 6-6 of FIG. 1.
Figure 7:
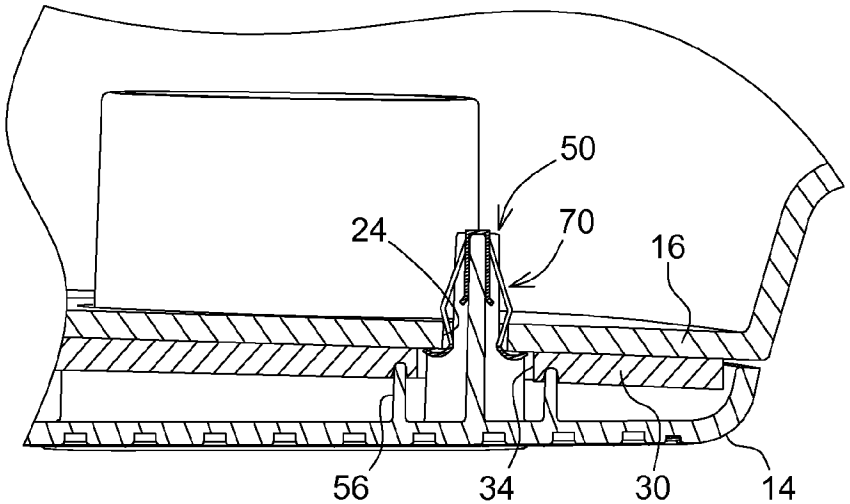
FIG. 7 is a sectional view along lines 7-7 of FIG. 1.

As best seen in FIGS. 1 and 3, the grille 14 includes generally rectangular plate 40 in which is formed a speaker opening 42, a tuned port 44 and an array or set of speaker perforations 46. A tapered port cylinder 48 surrounds the tuned port 44 and extends away from plate 40, though port openings 32 and 22 and into the box 12. Attachment or mounting tabs 50, 52 and 54 are spaced apart and project away from the plate 40, each having an H-shaped cross sectional shape. Mounting tabs 50-54 are molded in the grille 14. The base portion of each tab 50-54 is surrounded by a corresponding one of tab ribs 56, 58 and 60. Each rib forms a circular sealing surface. The base portion of the port cylinder 48 is surrounded by a circular port rib 62. As also shown by FIG. 7 with tab 50 as an example, each tab 50-54 forms four shoulder surfaces 64 which face away from and are spaced apart from the plate 16. Each tab 50-54 extends through a corresponding one of seal member slots 34-38 and slots 24-28 in the plate 16, in order to position the grille 14 relative to the plate 16 and to attach the grille 14 to the plate 16. As best seen in FIGS. 6 and 7, clips 70 are attached to the tabs 50-54 in order to maintain the grille 14 attached to the plate 16. The mounting tabs 50-54 are normal to the sealing surfaces formed by the ribs 56-60.

Again, as shown by FIG. 7, the shoulder surfaces 64 project through the slots 34-38 and engage the front surface of plate 16, and thereby position the grille 14 properly with respect to plate 16 when the grille 14 is assembled to the plate 16. This provides the correct spacing between the plate 16 and ribs 56, 58, 60, and 62 so that the ribs compress the seal 30 by the correct amount.

The result is a sound box 12 which is maximized for the space available in an overhead console (not shown) for an agricultural application. The face area of the sound box 12 is sufficiently large to allow for the tuned port 48 to be integrated into the speaker grille 14. The port 48 vents the air space located behind the speaker 19. The front plate 16 of the sound box has an opening and mounting points for the speaker 19.

The mounting tabs 50, 52 and 54 reduce the assembly time and are hidden mechanical fasteners that attach the speaker grille 14 to the front plate 16 of the sound box. Conventional spring clips attach to the tabs. Each clip is received by one of the slots 24-28 in the plate 16 so that the clip can expand against the back side of the plate 16 and hold the grille 14 to the plate 16. The slots in the plate 16 are sealed by the corresponding ribs 56-60 which pinch the seal member 30 to the portions of the plate 16 which surround each slot 24-28.

The length of the tune port 48 is greater than the thickness of the speaker grille 14 and extends into the sound box 12 past the plate 16. The tuned port 48 extends through the opening 22 and is exposed to the air space behind the speaker 19. A clearance is provided between the outer diameter of the tuned port 48 and the opening 22. The seal 30 is attached to the plate 16 with a pressure sensitive adhesive on the seal 30. The seal opening 32 has a slightly smaller diameter than the outside diameter of the tuned port 48. As a result, the seal 30 engages the outer surface of the port 48 and seals the gap just mentioned. The seal 30 is supported by the plate 16 so that as the tuned port 48 is inserted into the seal opening 32, the rubber foam seal material is stretched radially to provide a complete seal to the outer surface of the port 48. With this seal 30, the air space is now vented only through the inside of the tuned port 48.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. A speaker enclosure comprising:

a sound box, the sound box having an attachment plate;

an attachment port formed in the attachment plate;

a speaker grille attached to the sound box, the grille having a main plate, the grille having a tab which projects from the main plate through the attachment port, and the grille having a seal engagement member which projects from the main plate towards the sound box and which surrounds a base portion of the tab; and a resilient seal member, the seal member being compressed between the seal engagement member and the attachment plate.

2. The speaker enclosure of claim 1, wherein:

the grille forms a speaker opening and a tuned port spaced apart from the speaker opening, the grille forming a port cylinder which surrounds the tuned port, the seal member sealingly engaging an outer surface of the port cylinder.

3. The speaker enclosure of claim 1, wherein:

the seal engagement member comprises a tab rib which projects from a surface of the grille and which surrounds the base portion of the tab.

4. The speaker enclosure of claim 2, wherein:

the grille comprises a port rib which projects towards the attachment plate and which surrounds a base portion of the port cylinder;

a portion of the seal member being compressed between the attachment plate and the port rib.

5. A speaker enclosure comprising:

a sound box, the sound box having an attachment plate, the attachment plate having a plurality of attachment slots formed therein;

a speaker grille attached to the sound box, the grille having a main plate, the grille forming a speaker opening and a tuned port spaced apart from the speaker opening, the grille having a plurality of tabs, each tab projecting from the main plate through a corresponding one of the attachment slots, and the grille having a plurality of tab ribs which projects from the main plate towards the attachment plate, each tab rib surrounding a base portion of a corresponding one of the tabs; and a resilient seal member, portions of the seal member being compressed between the attachment plate and each of the tab ribs.

6. The speaker enclosure of claim 5, wherein:

the grille forms a port cylinder which surrounds the tuned port, the seal member sealingly engaging an outer surface of the port cylinder.

7. The speaker enclosure of claim 6, wherein:

the grille comprises a port rib which projects towards the attachment plate and which surrounds a base portion of the port cylinder;

a portion of the seal member being compressed between the attachment plate and the port rib.

8. A speaker enclosure comprising:

a sound box, the sound box having an attachment plate, the attachment plate having a plurality of attachment slots formed therein;

a speaker grille attached to the sound box, the grille having a main plate and forming a speaker opening and a port cylinder which surrounds a tuned port spaced apart from the speaker opening, the grille having a plurality of tabs, each tab projecting from the main plate through a corresponding one of the attachment slots, the grille having a plurality of tab ribs which projects from the main plate towards the attachment plate, each tab rib surrounding a base portion of a corresponding one of the tabs, and the grille having a port rib which projects towards the attachment plate and which surrounds a base portion of the port cylinder; and a resilient seal member, portions of the seal member being compressed between the attachment plate and each of the tab ribs and another portion of the seal member being compressed between the attachment plate and the port rib.

9. The speaker enclosure of claim 8, wherein:

the seal member sealingly engages an outer surface of the port cylinder.

10. The speaker enclosure of claim 8, wherein:

the seal member includes a port opening which receives the port cylinder and a plurality of tab openings, each tab opening receiving a corresponding one of the tabs.

* * * * *